US008231484B1

(12) United States Patent
Quinn

(10) Patent No.: US 8,231,484 B1
(45) Date of Patent: Jul. 31, 2012

(54) VARIABLE INERTIA BAT WEIGHT

(75) Inventor: Charles T Quinn, Dover, MA (US)

(73) Assignee: Franklin Sports, Inc., Stoughton, MA (US)

( * ) Notice: Subject to any disclaimer, the term of this patent is extended or adjusted under 35 U.S.C. 154(b) by 110 days.

(21) Appl. No.: 12/773,800

(22) Filed: May 4, 2010

(51) Int. Cl.
*A63B 69/00* (2006.01)

(52) U.S. Cl. ..... 473/437; 473/422; 473/457; 482/105

(58) Field of Classification Search ..... 473/437, 473/457, 422; 482/93, 105; D21/683; D2/973
See application file for complete search history.

(56) References Cited

U.S. PATENT DOCUMENTS

| | | | | |
|---|---|---|---|---|
| 3,521,883 | A | 7/1970 | Hamilton | |
| 3,623,724 | A | 11/1971 | Lande | |
| 3,640,273 | A * | 2/1972 | Ray | 602/5 |
| 4,273,130 | A * | 6/1981 | Simpson | 606/203 |
| D278,455 | S * | 4/1985 | Nosek | D21/683 |
| 4,676,247 | A * | 6/1987 | Van Cleve | 607/112 |
| 5,050,877 | A | 9/1991 | Wales | |
| 5,888,154 | A | 3/1999 | Hartmand | |
| 5,980,397 | A * | 11/1999 | Hart et al. | 473/437 |
| 6,533,685 | B1 * | 3/2003 | Otten et al. | 473/437 |
| 2004/0209711 | A1 * | 10/2004 | Liberatore | 473/457 |
| 2005/0277491 | A1 * | 12/2005 | Nolan | 473/451 |
| 2009/0069126 | A1 * | 3/2009 | Merchant | 473/437 |

* cited by examiner

*Primary Examiner* — Gene Kim
*Assistant Examiner* — M Chambers
(74) *Attorney, Agent, or Firm* — Joseph B Bowman

(57) ABSTRACT

A variable inertia bat weight training aid having a sleeve with radially divided, elongate pockets in which are permanently captured a plurality of weights. One end of the sleeve has a diameter sufficient to receive the barrel of a baseball bat but the other end of the sleeve includes a restricting band having a diameter sufficient to receive the handle of the bat but insufficient to pass over the barrel of the bat. Each weight within an associate pocket may be adjustably positioned along the length of the sleeve and secured in place by a restraining strap in order to vary the inertial resistance of the baseball bat and the perceived weight a batter experiences for warm-up and strength training exercises.

10 Claims, 5 Drawing Sheets

VARIABLE INERTIA BAT WEIGHT

CROSS-REFERENCE TO RELATED APPLICATIONS

This application has no related applications.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a batting weight. More specifically, this invention relates to a variable, but captured, weight batting sleeve to be removably secured to a baseball bat for training and warm-up swings.

To baseball fans and players alike, the use of a batting weight in the form of a donut weight slipped over a baseball bat for the purpose of warm-up swings by a batter is a familiar sight. For a physics explanation, the batting weight increases the overall bat weight and the inertial resistance of a warm-up swing. After taking a few practice swings, the batting weight is removed and the batter then has the sense of handling a lighter and decidedly quicker bat when at the plate.

The benefits of a batting weight have been extended to strength training sessions in addition to use in warm-ups. By repeated practice of swings with a weighted bat, the batter is able to increase muscle strength and improve reaction times. U.S. Pat. No. 3,521,883 of Hamilton is representative of an earlier example of such a training device. From the characteristic donut shape, various sleeves were later developed for better balance or resistance distribution along the length of the baseball bat. Examples of such developments are disclosed in U.S. Pat. No. 3,623,724 of Lande, U.S. Pat. No. 5,050,877 of Wales, U.S. Pat. No. 5,888,154 of Hartman, and U.S. Pat. No. 6,533,685 of Otten et al As the use of batting training aids became more widespread in both warm-up exercises and strength training, the need for a variable weight batting device was recognized in order to accommodate batters of differing statures, strengths and abilities. For any given batter, a variable weight device would also be desirable in order to gradually increase weight of the training device over the course of an extended training regiment. U.S. Pat. No. 5,980,397 of Hart et al discloses a sack having multiple pockets in which removable weight packets may be placed. With the sack containing weights wrapped around a baseball bat, a plurality of Velcro straps are attached to the sack to encircle the bat and permit this training device to be positioned at various locations along the length of the bat. Such a system for batting weight training was not without its drawbacks however. There is a danger in the weight packets being ejected from an associated pocket of the device during a vigorous swing, as well as the annoying need to keep track of multiple weight packets which can easily be lost or misplaced when not installed within pockets of the training device. A significant danger of this prior art device is the risk of the entire training aid being propelled from the end of the bat when improperly installed or when the Velcro straps failed to hold. Thus, a weighted missile can pose injury to other players or bystanders in the event of a hasty installation or less than perfect contact of the retaining straps.

Therefore, a need remains in the field of baseball sports training for a safe batting weight capable of adjustably varying the inertial resistance of a baseball bat and the perceived weight a batter experiences for warm-up and strength training exercises. The primary objective of this invention is to meet this need.

SUMMARY OF THE INVENTION

More specifically, an object of the invention is to provide a variable inertia bat weight training aid that may be quickly and positively inserted on a baseball bat without the risk of detaching weights or the training aid itself during successive bat swings.

An object of the invention is to provide a variable inertia bat weight training aid that can be safely installed on or removed from a baseball bat over the handle end thereof and that cannot be removed over the barrel end of the baseball bat.

An object of the invention is to provide a variable inertia bat weight training aid having a plurality of captured weights therein that may be adjustably positioned along a baseball bat but which may not be removed from the training aid itself.

An object of the invention is to provide a variable inertia bat weight training aid of the character described having a plurality of captured weights which may be adjustably locked in a preselected position along the length of the training aid in order to vary the moment of inertia of the baseball bat on which the training aid is mounted In summary, an object of the invention is to provide a variable inertia bat weight training aid having a sleeve with radially divided, elongate pockets in which are permanently captured a plurality of weights. One end of the sleeve has a diameter sufficient to receive the barrel of a baseball bat but the other end of the sleeve includes a restricting band having a diameter sufficient to receive the handle of the bat but insufficient to pass over the barrel of the bat. Each weight within an associate pocket may be adjustably positioned along the length of the sleeve and secured in place by a restraining strap in order to vary the inertial resistance of the baseball bat and the perceived weight a batter experiences for warm-up and strength training exercises.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
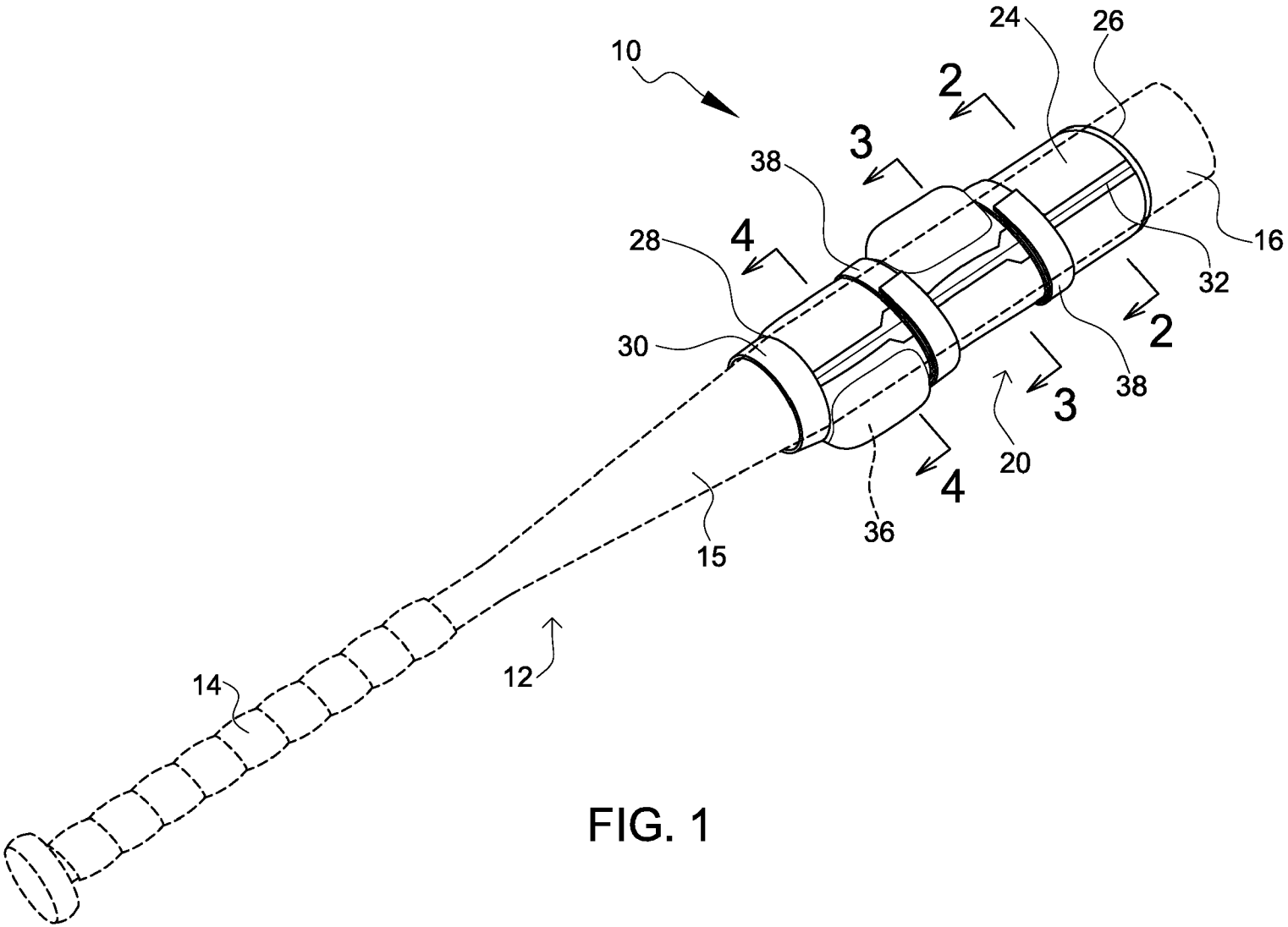
FIG. 1 is a perspective view of a variable inertia bat weight training aid constructed in accordance with a preferred embodiment of the invention.

Referring to the drawings in greater detail, attention is first directed to FIG. 1 with the training aid 10 of the invention shown installed on a broken line illustration of a conventional baseball or softball bat 12. The bat 12 includes a handle portion 14, a barrel portion 16 of substantially uniform diameter for the intended purpose of striking a ball, and a tapered transition portion 15 from the handle 14 to the barrel 16.

The bat weight training aid 10 includes a double layered, flexible sleeve 20 having an inner sleeve layer 22 for contacting the surface of the bat 12 (see FIGS. 2-4) and an exterior sleeve layer 24. Both the distal end 26 and the proximal end 28 of the sleeve 20 are closed. The distal end 26 refers to that end of the sleeve 20 intended to be furthest from the bat handle 14 while the proximal end 28 refers to that end of the sleeve 20 intended to be closest to the bat handle 14.

The sleeve 20 is fabricated from flexible material. Preferably, the material is strong yet somewhat stretchable such as a neoprene or similar synthetic. Fabrication from such type of material prevents marring of the bat surface.

Although the sleeve 20 is flexible, when installed on the bat 12, it conforms to a generally cylindrical form and, therefore, the sleeve 20 is sized to have an implied diameter. From the distal end 26 and throughout most of its length, the sleeve 20 has a diameter substantially equal to or slightly greater than the diameter of the barrel 16 of the bat 12. However, the proximal end 28 of the sleeve 20 is attached to a restricting band 30 that, when the sleeve 20 is installed on the bat 12, represents a diameter smaller than the diameter of the bat barrel 16, but larger than any part of the bat handle 14. Accordingly, depending on the physical dimensions of the bat 10, the restricting band 30 will coincide with the diameter of the bat 12 somewhere along the length of the tapered portion 15. The restricting band 30 must be smaller than the diameter of the bat barrel 16 in order to positively prevent the training aid 10 from slipping off the barrel end of the bat 12.

Figure 2:
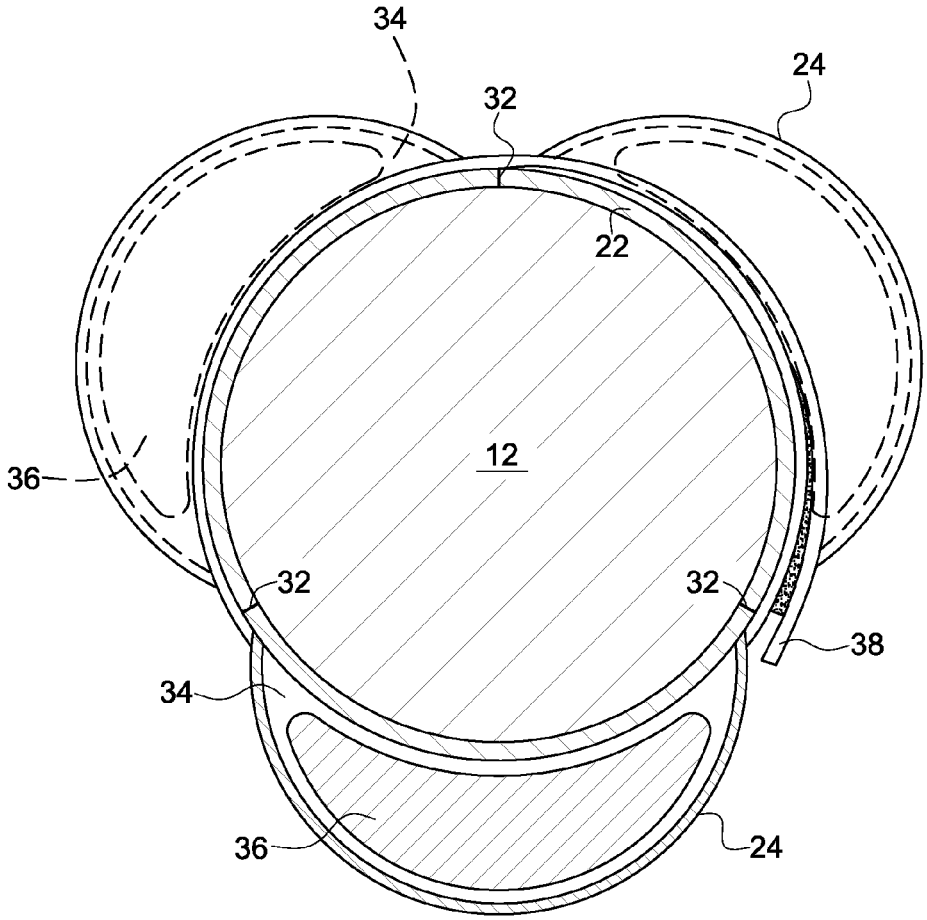
FIG. 2 is a sectional view taken along line 2-2 of FIG. 1 in the direction of the arrows.
Figure 3:
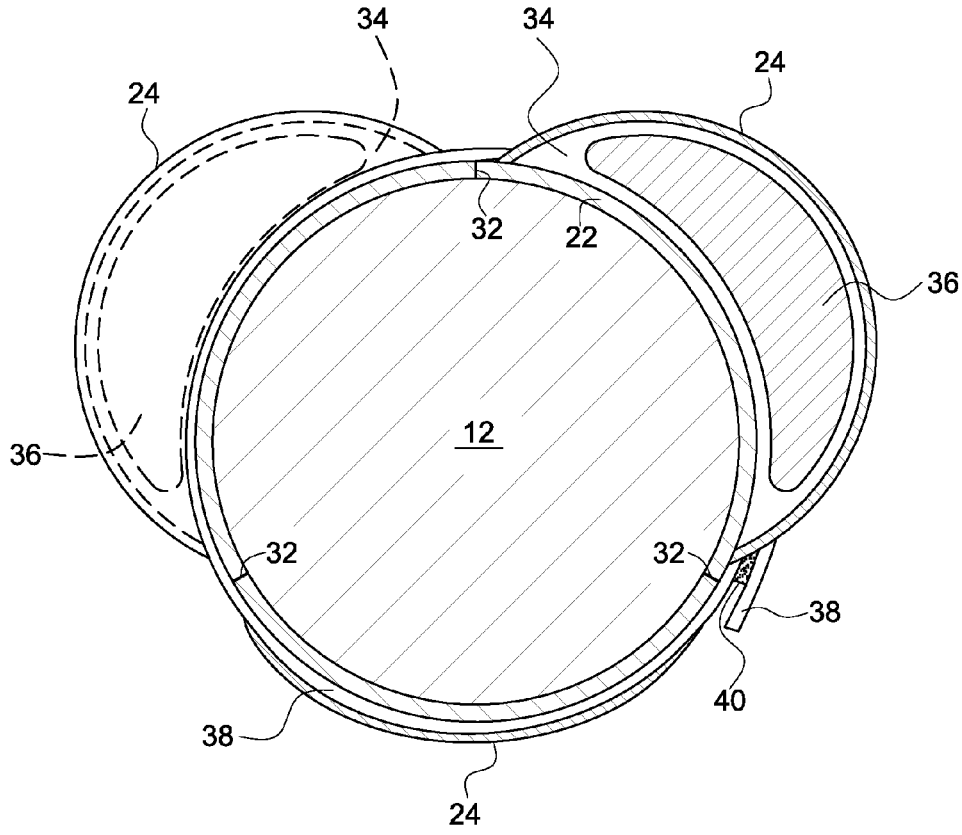
FIG. 3 is a sectional view taken along line 3-3 of FIG. 1 in the direction of the arrows.
Figure 4:
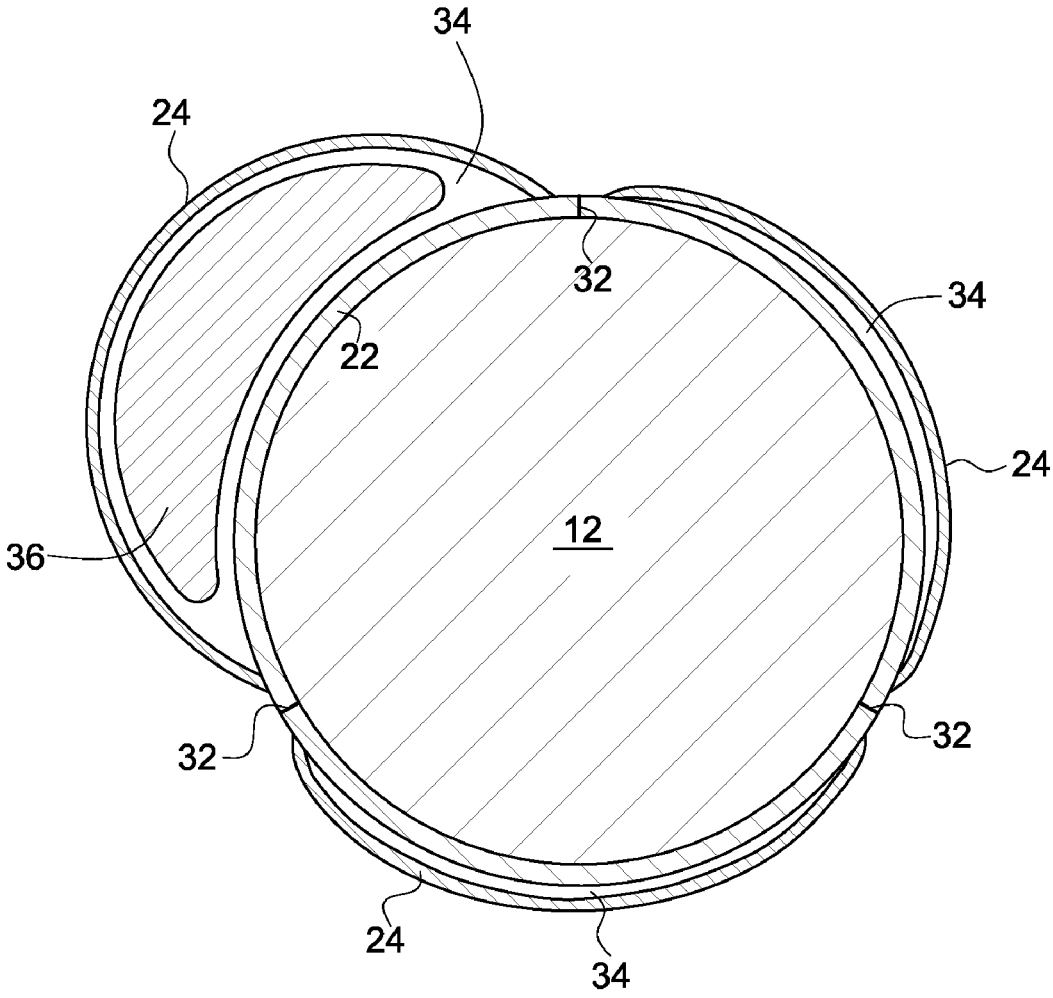
FIG. 4 is a sectional view taken along line 4-4 of FIG. 1 in the direction of the arrows.

The sleeve 20 is divided, as by longitudinal seams 32, into a plurality of radial pockets 34 which extend substantially the length of the sleeve 20. Three such pockets 34 are illustrated in drawings. Accordingly, the three seams 32 are oriented at approximately 120 degrees as shown in FIGS. 2-4 around the central axis of the sleeve 20.

Captured within each such pocket 34 is a weight member 36 that can be moved throughout the length of the pocket 34. As illustrated in FIGS. 2-4, each weight 36 preferably has a concave inner surface to substantially match the curvature of the bat barrel 16.

Figure 5:
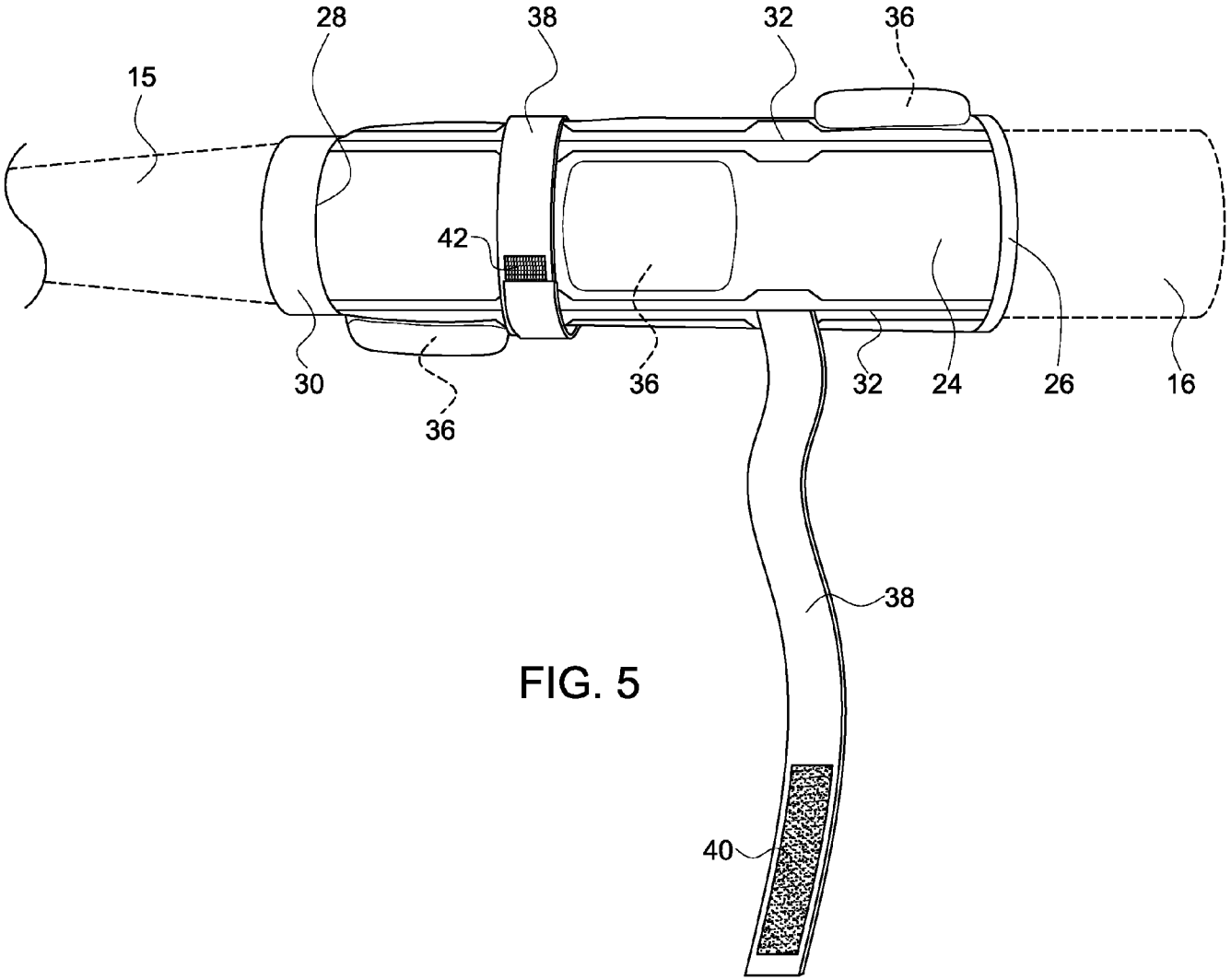
FIG. 5 is an enlarged, side elevational view of the training aid illustrating the lowermost weight positioning strap latched around the sleeve and the uppermost strap unlatched to reposition individual weights carried within the sleeve.

Intermediate the ends 26 & 28 of the sleeve 20 are secured a plurality of retaining straps 38. Each strap 38 is of sufficient length to encircle the diameter of the training aid 10 and then lap a portion of itself. Two such straps 38 are illustrated in the drawings. Each strap 38 includes a two part latch and hook fastener 40 & 42 of the type commonly referred to as a Velcro fastener. One part 40 of the latch and hook fastener is attached to the inside surface of the strap 38 near the outer end thereof as illustrated in the unfastened strap 38 shown in FIG. 5 nearest the distal end of the sleeve 20. The mating or second part 42 of the latch and hook fastener is attached to the outside surface of the strap 38 at a location to mate with the first part 40 of the fastener when the restraining strap 29 encircles the sleeve 20.

The restraining straps 38 are spaced along the length of sleeve 20 at distances sufficient to accommodate the length of a weight member 36 within the pockets 34. The use of two straps 38 thus divides the length of the sleeve 20 into three sections wherein a weight 36 may be selectively positioned in each of the three such sections. At the distal end 26 of the sleeve 20, the weight 36 is confined between the distal end 26 and the adjacent strap 38. In the intermediate section, the weight 36 is confined by the adjacent two straps 38 and at the proximal end 28 of the sleeve 20 the weight is confined between the proximal end 28 and the adjacent strap 38.

In the preferred configuration illustrated, there are three radial pockets 34 which extend the length of the sleeve 20, each having a captured weight 36. The two restraining straps 38 spaced along the length of the sleeve 20 thus provide sections one, two and three in which a weight 36 may be restrained in a respective pocket 34. This yields ten different possibilities for changing the moment of inertia of the bat 12 as follows. For purposes of this explanation, section one is that portion of the sleeve 20 between the proximal end 28 and the first strap 38, section two is that portion between the two straps 38, and section three is that portion between the second strap 38 and the distal end 26. As a first arrangement, therefore, all three weights 36 may be positioned in section one of the sleeve 20. As a second arrangement, two weights may be positioned in section one and one weight in section two. As a third arrangement, two weights may be positioned in section one and one weight in section three. As a fourth arrangement, one weight may be positioned in section one and two weights in section two. As a fifth arrangement, one weight may be positioned in section one, one weight in section two and one weight in section three. As a sixth arrangement, one weight may be positioned in section one and two weights in section three. As a seventh arrangement, all three weights may be positioned in section two. As an eighth arrangement, two weights may be positioned in section two and one weight in section three. As a ninth arrangement, one weight may be positioned in section two and two weights in section three. And as a tenth and last arrangement, all three weights may be positioned in section three.

It will be understood from the foregoing explanation that greater or fewer combinations of different inertial resistance may be achieved by varying the number of radial pockets 34 oriented around the sleeve 20 and/or by varying the number of straps 34 which divide the sleeve 20 into sections for restraining the weights 36 captured within sleeve 20 itself.

In operation, therefore, the training aid 10 is inserted over the handle portion 14 of the bat 12 and slid onto the barrel 16 until the restricting band 30 limits further travel along the bat 12. The user then slides the weights 36 along the sleeve 20 in accordance with the user's abilities and desired moment of inertia. Generally, when first using the training aid 10, the user may prefer to start with all three weights 36 closer to the handle 14 or proximal end 28 of the sleeve 20 to experience the lowest moment of inertia in order to begin exercise training. When all three weights 36 have been positioned as desired, then the retaining straps 38 may be wrapped around the sleeve 20 and latched with the two part latch and hook fastener to prevent the weights from being displaced during exercise swings of the bat. If a greater moment of inertia is desired, the user simply unwraps the retaining straps 38 and repositions one or more of the weights 36 further toward the distal end 26 of the sleeve 20.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

I claim:

1. A variable inertia bat training aid for a bat having a barrel of substantially uniform diameter, a narrower handle portion and a tapered transition from the handle portion to the barrel, said training aid comprising:

a double layered sleeve having a diameter sufficient to receive said bat barrel and having a length to extend along at least a portion of said bat barrel, said sleeve having closed ends with a proximal end having a diameter less than said barrel diameter;

a plurality of partitioning elements running lengthwise of said sleeve to establish a plurality of closed, elongate radial pockets substantially the length of said sleeve;

a plurality of weights corresponding in number to the number of radial pockets with one said weight being captured within each said radial pocket and each said weight being substantially shorter in length than the length of said radial pocket in order to be selectively moveable along the length thereof; and a plurality of restraining members adapted to encircle said sleeve to restrict movement of said weights captured within said radial pockets along the length of said sleeve;

whereby said sleeve may be inserted over said bat handle and slid along said bat until limited in further travel by said proximal end of said sleeve and then said weights may be individually positioned along the length of said sleeve and held in place by said restraining members to achieve a preselected moment of inertia for bat training exercises.

2. The training aid as in claim 1, said sleeve having an inner flexible layer for contact with said bat and an outer flexible layer wherein said inner and outer layers are joined to each other at the ends of said sleeve.

3. The training aid as in claim 2, said partitioning elements comprising seams joining said inner and outer layers along the length of said sleeve.

4. The training aid as in claim 2, said inner and outer layers being fabricated from neoprene material.

5. The training aid as in claim 1, said partitioning elements being three in number arranged at 120 degrees around said sleeve.

6. The training aid as in claim 5, said weights comprising three in number with one disposed in each of said pockets established by said partitioning elements.

7. The training aid as in claim 1 further including a constriction band connected to the proximal end of said sleeve and having a diameter less than the diameter of said bat barrel in order to prevent said sleeve from sliding off said bat barrel.

8. The training aid as in claim 1, said weights having an inside longitudinally concave surface substantially corresponding to the diameter of said bat barrel.

9. The training aid as in claim 1, each said restraining member comprising a strap secured to said sleeve along the length thereof and spaced apart from said sleeve ends and adjacent said straps to accommodate said weight therebetween.

10. The training aid as in claim 1, said restraining members comprising two in number and being evenly spaced along said sleeve to define three sleeve sections for receiving said weights.

* * * * *